US010271618B2

(12) United States Patent
La Rocca et al.

(10) Patent No.: US 10,271,618 B2
(45) Date of Patent: Apr. 30, 2019

(54) SLIDE FASTENER STRINGER AND METHOD FOR FABRICATION THEREOF

(71) Applicant: YKK Corporation, Tokyo (JP)

(72) Inventors: Giovanni La Rocca, Vercelli (IT); Gabriele Biava, Vercelli (IT); Pier Marco Gabutti, Vercelli (IT)

(73) Assignee: YKK Corporation (JP)

( * ) Notice: Subject to any disclaimer, the term of this patent is extended or adjusted under 35 U.S.C. 154(b) by 335 days.

(21) Appl. No.: 15/026,893

(22) PCT Filed: Sep. 26, 2014

(86) PCT No.: PCT/JP2014/075643
§ 371 (c)(1),
(2) Date: Apr. 1, 2016

(87) PCT Pub. No.: WO2015/050058
PCT Pub. Date: Apr. 9, 2015

(65) Prior Publication Data

US 2016/0255920 A1 Sep. 8, 2016

(30) Foreign Application Priority Data

Oct. 2, 2013 (IT) ..... TO2013A000789

(51) Int. Cl.
*A44B 19/06* (2006.01)
*A44B 19/34* (2006.01)
(Continued)

(52) U.S. Cl.
CPC ..... *A44B 19/34* (2013.01); *A44B 19/12* (2013.01); *A44B 19/343* (2013.01);
(Continued)

(58) Field of Classification Search
CPC ..... A44B 1/32; A44B 19/34; A44B 19/343; A44B 19/346; A44B 19/40; A44B 19/406;
(Continued)

(56) References Cited

U.S. PATENT DOCUMENTS 4,580,321 A 4/1986 Tanikawa et al.
4,596,065 A 6/1986 Tanikawa et al.
(Continued)

FOREIGN PATENT DOCUMENTS

JP 60-246704 A 12/1985
JP 2000-312604 A 11/2000
(Continued)

OTHER PUBLICATIONS

Supplementary European Search Report, European Patent Application No. 14850885.6, dated Mar. 27, 2017.
(Continued)

*Primary Examiner* — Jack W Lavinder
(74) *Attorney, Agent, or Firm* — Kilpatrick Townsend & Stockton LLP

(57) ABSTRACT

There is provided a slide fastener stringer. A substrate tape includes a first main side having a rough surface structure perceptible to the eye and/or the touch and a second main side opposite to the first main side. A gripping member is affixed to a longitudinal edge of the first main side of the substrate tape. A cover sheet is made of an artificial flexible material and has a 5 top surface provided with a predetermined design and a bottom layer made of a thermoformable material having a predetermined thickness. The bottom layer is attached to the second main side of the substrate tape such that the surface structure of the second main side of the substrate tape is not perceivable through the cover sheet.

11 Claims, 7 Drawing Sheets

(51) Int. Cl.
*A44B 19/12* (2006.01)
*A44B 19/40* (2006.01)
*A44B 19/42* (2006.01)

(52) U.S. Cl.
CPC ..... *A44B 19/346* (2013.01); *A44B 19/406* (2013.01); *A44B 19/42* (2013.01)

(58) Field of Classification Search
CPC ..... A44B 19/50; A44B 19/52; A44B 19/42; Y10T 24/2518; Y10T 24/2527; Y10T 24/2529; Y10T 24/253
See application file for complete search history.

(56) References Cited

U.S. PATENT DOCUMENTS 6,105,214 A 8/2000 Press
6,427,294 B1 8/2002 Shibaike et al.
2007/0094852 A1 5/2007 Yen-Ping
2011/0005042 A1* 1/2011 Thomas ..... A44B 19/32 24/381

FOREIGN PATENT DOCUMENTS

JP 2002-525143 A 8/2002
WO 2009/068848 A2 6/2009

OTHER PUBLICATIONS

International Preliminary Report on Patentability, PCT Application No. PCT/JP2014/075643, dated Apr. 14, 2016.
International Search Report, PCT Application No. PCT/JP2014/075643, dated Dec. 22, 2014.
Written Opinion, PCT Application No. PCT/JP2014/075643, dated Dec. 22, 2014.

* cited by examiner

SLIDE FASTENER STRINGER AND METHOD FOR FABRICATION THEREOF

This application is a national stage application of PCT/JP2014/075643, which claims priority to Italian Patent Application No. TO2013A000789, both of which are incorporated herein by reference.

TECHNICAL FIELD

The present invention generally relates to slide fasters. More specifically the present invention related to slide fastener stringers and methods for manufacturing thereof.

BACKGROUND ART

Known slide fastener stringer comprises a substrate tape made of a flexible material which is generally a fabric and having a first main side having a rough (i.e. non-smooth) surface structure perceptible to the eye and/or the touch and a second main side opposite to the first main side, and a coil-like coupling element affixed along a longitudinal edge of the first main side of the substrate tape.

It is known to attach to the second main side of the substrate tape, a relatively much thinner cover film made of an artificial flexible material such as synthetic resin in order to provide some degree of water-tightness. As an alternative, the cover film is provided with a predetermined design, intended to remain at least partially visible in use.

The substrate tapes used for the manufacture of the slide fastener stringers are generally made of interlaced, wove, knitted or knotted fibers, filaments, threads or yarns. Such a substrate tape confers thereto a rough surface structure which remains perceptible to the eye and/or the touch through the cover film possibly attached to the substrate tape.

SUMMARY OF INVENTION

Problems to be Solved by Invention

An object of the present invention is to provide an improved slide fastener stringer which allows the limitations and inconveniences of the related-art stringers to be overcome.

Means for Solving Problems

The above-described object of the present invention can be achieved by the following configurations.

(1) A slide fastener stringer, comprising: a substrate tape comprising a first main side having a rough surface structure perceptible to the eye and/or the touch and a second main side opposite to the first main side; gripping means affixed to a longitudinal edge of the first main side of the substrate tape; and a cover sheet made of an artificial flexible material and having a top surface provided with a predetermined design and a bottom layer made of a thermoformable material having a predetermined thickness, wherein the bottom layer is attached to the second main side of the substrate tape such that the surface structure of the second main side of the substrate tape is not perceivable through the cover sheet.

(2) The slide fastener stringer according to (1), wherein the bottom layer of the cover sheet is made of a compressible material.

(3) The slide fastener stringer according to (1) or (2), wherein the substrate tape includes a fabric made of interlaced, woven, knitted or knotted fibers, filaments, threads or yarns.

(4) The slide fastener stringer according to any of (1) to (3), wherein the gripping means comprise a coil-like coupling element stitched to the substrate tape.

(5) The slide fastener stringer according to (4), wherein the coupling element is stitched to at least one of the substrate tape and the cover sheet.

(6) The slide fastener stringer according to any of (1) to (5), wherein neither a thickness of the substrate tape nor a thickness of the cover sheet is 50% greater than the other.

(7) The slide fastener stringer according to (6), wherein the cover sheet is attached to the substrate tape by means of a resin film.

(8) A method for manufacturing the slide fastener stringer according to any of (1) to (7), the method comprising: providing the substrate tape and the cover sheet; adhesively attaching the bottom layer of the cover sheet to the second main side of the substrate tape such that the bottom layer of the cover sheet is essentially complementarily conformed to the surface structure of the second main side of the substrate tape.

(9) The method according to (8), wherein the bottom layer of the cover sheet is attached to the second main side of the substrate tape while compressing the bottom layer of the cover sheet.

(10) The method according to (8) or (9), wherein the gripping means is affixed to the first main side of the substrate tape after the cover sheet is affixed to the substrate tape.

(11) The method according to (8) or (9), wherein the gripping means is affixed to the first main side of the substrate tape before the cover sheet is affixed to the substrate tape.

(12) The method according to any of (8) to (11), comprising: providing a substrate band comprising a first main side having a rough surface structure perceptible to the eye and/or the touch and a second main side opposite to the first main side, the substrate band having a transverse width which is substantially twice that of the substrate tape; providing a cover band having a transverse width which is substantially twice that of the cover sheet; and adhesively attaching a bottom layer of the cover band to the second main side of the substrate band such that the bottom layer of the cover band is essentially complementarily conformed to the surface structure of the second main side of the substrate band.

(13) The method according to (12), wherein the substrate band and the cover band are cut at the center thereof in a width direction.

Advantageous Effects of Invention

According to the present invention, a slide fastener stringer comprises: a substrate tape comprising a first main side having a rough surface structure perceptible to the eye and/or the touch and a second main side opposite to the first main side; gripping means affixed to a longitudinal edge of the first main side of the substrate tape; and a cover sheet made of an artificial flexible material and having a top surface provided with a predetermined design and a bottom layer made of a thermoformable material having a predetermined thickness, and the bottom layer is attached to the second main side of the substrate tape such that the surface structure of the second main side of the substrate tape is not perceivable through the cover sheet. Thus, it is possible to make the rough surface structure of the second main side of the substrate tape be not perceivable to the eye and/or the touch and to confer the predetermined design on the second surface side of the substrate tape.

Further features and advantages of the present invention will become apparent from the following description provided merely bay way of non-limiting examples, with reference to the drawings.

EMBODIMENTS OF INVENTION

Figure 1:
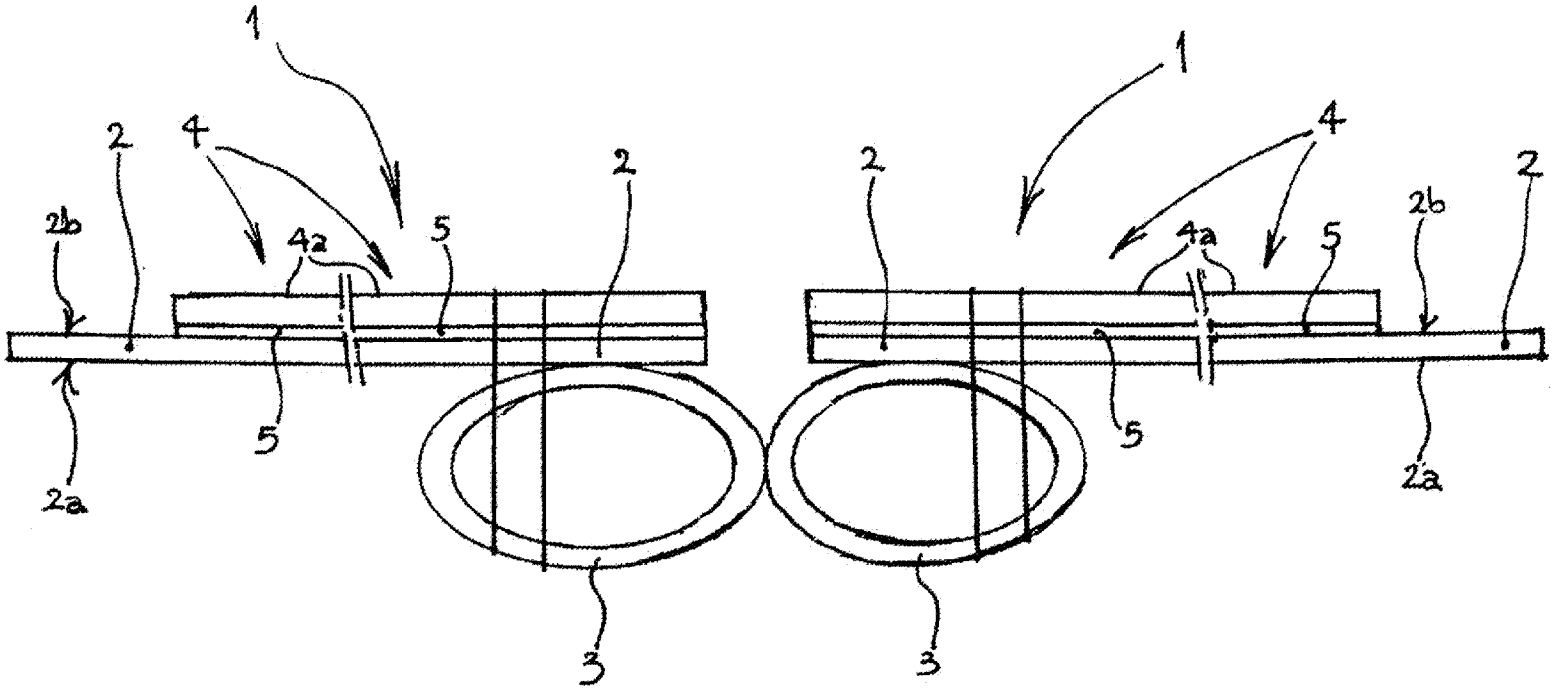
FIG. 1 is a cross-sectional view of two confronting stringers for the manufacture of slide fasteners.

In FIG. 1, there are shown in transverse cross-sectional view two confronting slide fastener stringers 1 manufactured in accordance with the present invention.

Each stringer 1 comprises a substrate tape 2 made of a flexible material, in particular a fabric which is made of fibers, filaments, threads or yarns. The fabric may be interlaced, woven, knitted or knotted and has a first main side 2*a* and a second main side 2*b* opposite to the first main side 2*a*.

Since the surface structures of the first and second main sides 2*a*, 2*b* are the textile nature, the substrate tape 2 has an irregular and rough (i.e. non-smooth) surface structure which is perceptible to the eye and/or the touch by the human body. In particular, though this is not shown in the drawings, the first and second main sides 2*a*, 2*b* of the substrate tape 2 have irregular surfaces comprised of a plurality of convexes and concaves.

To the first main sides 2*a* of the substrate tapes 2, gripping means such as for instance coil-like coupling elements 3 are affixed. The two confronting stringers 1 shown in FIG. 1 have a mutually symmetrical configuration. The coupling elements 3 on respective stringers 1 are configured to engage and disengage with and from each other for closing and opening the zipper or slide fastener in which they are incorporated, particularly in cooperation with a per se known slide fastener slider (now shown).

In the two confronting stringers 1 shown in FIG. 1, cover sheets 4 are respectively adhesively attached to the second main sides 2*b* of the respective substrate tapes 2. Each cover sheet 4 is made of an artificial flexible material and is flexible. In addition, each cover sheet 4 has a top surface 4*a* provided with a predetermined design. The design is for instance a picture, characters, woven-like texture patterns, animal or plant skin-like texture patterns, building wall or floor-like texture patterns or the like.

Figure 2:
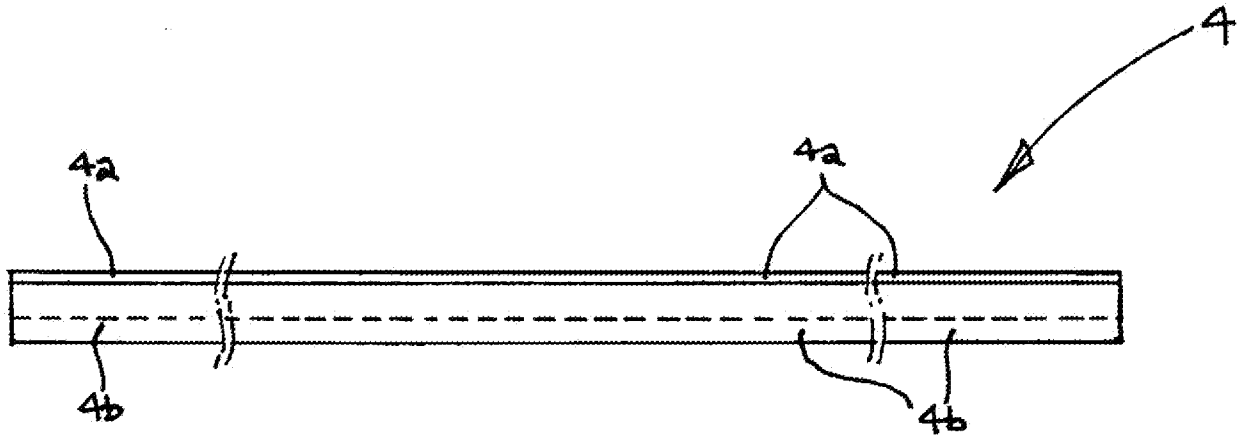
FIG. 2 is a transverse cross-sectional view of a cover sheet for use in the manufacture of slide fastener stringers according to the present invention.

As shown in FIG. 2, on the side opposite to the top surface 4*a*, each cover sheet 4 has a thermoformable bottom layer 4*b* having a predetermined thickness. Preferably, the bottom layer 4*b* is made of a compressible material. In principle the whole cover sheet 4 could be made of such a compressible, thermoformable material. For instance, the cover sheet 4 can be made of a complex material known as a trade name of "ALCANTARA" (Registered Trademark) consisting of about 68% of polyester and 32% of polyurethane.

Each cover sheet 4 is attached, at its bottom layer 4*b*, to the second main side 2*b* of the corresponding substrate tape 2. The attachment of the cover sheet 4 to the substrate tape 2 can be achieved for instance by interposing resin film 5 (FIG. 1) such as a polyurethane film between the second main side 2*b* of the substrate tape 2 and the bottom layer 4*b* of the cover sheet 4. That is, the resin film 5 serves as an adhesive layer for attaching the cover sheet 4 to the substrate tape 2. Neither the thickness of the substrate tape 2 nor the thickness of the cover sheet 4 is 50% greater than the other. Consequently, it is possible to suppress the convex and concave on the second main side 2*b* to the small size and to make the thickness of the bottom layer 4*b* thin.

The attachment of the cover sheet 4 to the substrate tape 2 can be performed by a lamination process, as it will be described in detail later with reference to FIG. 4.

Preferably, two slide fastener stringers can be manufactured at the same time by the method which is disclosed hereunder. The person skilled in the art will realize that such a method can be easily modified so as to manufacture a single stringer at a time.

Figure 3:
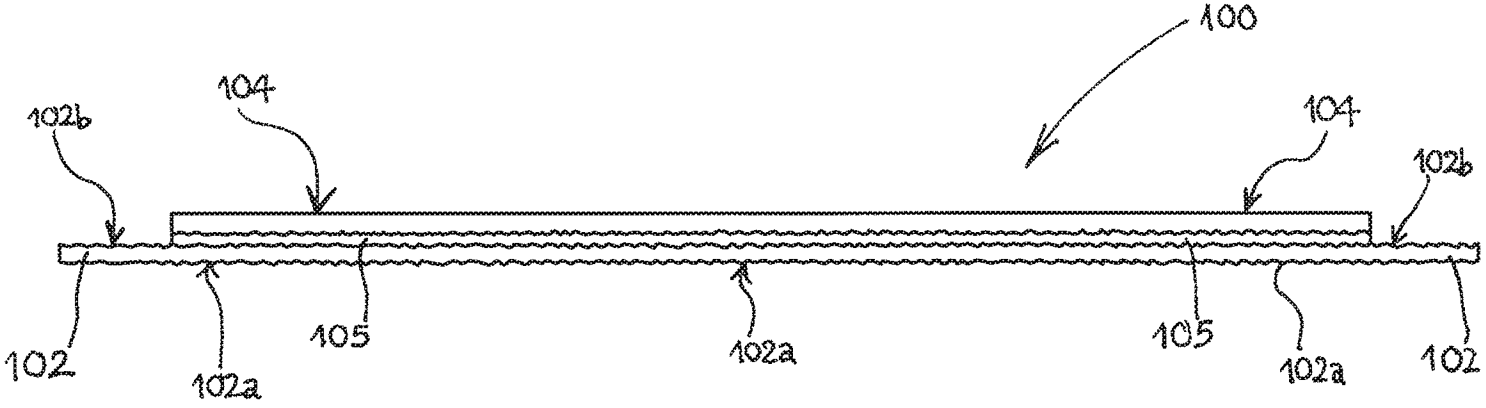
FIG. 3 is a transverse cross-sectional view of a laminate comprising the cover sheet of FIG. 2.

With reference to FIG. 3, in a preferred manufacturing method, there is provided a substrate band 102 made of the flexible material described above in connection with the substrate tapes 2 of the stringers 1. The substrate band 102 has a transverse width which is substantially twice that of each substrate tape 2.

The substrate band 102 has the same structure of the substrate tape 2. That is, the substrate band 102 has a first main side 102*a* and a second main side 102*b* opposite to the first main side 102*a*. At least the second main side 102*b* has a non-smooth surface structure perceptible to the eye and/or the touch.

In the preferred manufacturing method, there is provided a cover band 104 made of the artificial flexible material described above in connection with the cover sheet 4. The cover band 104 has a transverse width which is substantially twice that of cover sheet 4. And the cover band 104 is adhesively attached to the second main side 102*b* of the substrate band 102 by means of, for instance, a thin layer of the resin film 105, in particular a polyurethane film.

In addition, the cover band 104 in transverse cross-section has the same structure as the cover sheet 4 shown in FIG. 2. That is, the cover band 104 has a thermoformable bottom layer 4*b*. Preferably, the bottom layer 4*b* is made of a compressible material. And the cover band 104 is adhesively attached to the substrate band 102 at its bottom layer.

Figure 4:
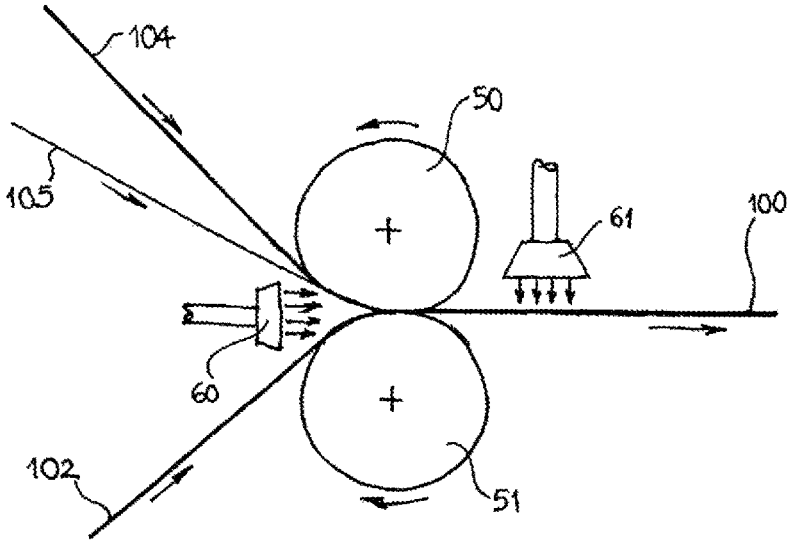
FIG. 4 is a schematic view illustrating an apparatus for providing a laminate for use in the manufacture of slide fastener stringers according to the present invention.

The lamination of the cover band 104 to the substrate band 102 can be appropriately performed using the lamination apparatus shown in FIG. 4. The lamination apparatus has pressing means disposed on a conveying path of the cover band 104 and the substrate band 102. The pressing means have two rollers 50, 51 which are disposed so as to face each other in a vertical direction. The cover band 104 and the substrate band 102 are supplied to a gap defined between the two rollers 50, 51, with a resin film 105 interposed therebetween. Consequently, the cover band 104 and the substrate band 102 are nipped by the two rollers 50, 51.

The two rollers 50, 51 press the cover band 104 and the substrate band 102 in a mutually approaching direction with a predetermined pressure. The two rollers 50, 51 rotate in opposite directions to each other. Consequently, the cover band 104 and the substrate band 102 are fed from the gap defined between the rollers 50, 51 while contacting the rollers 50, 51. That is, the pressing means feeds a laminate 100 in which the cover band 104 and the substrate band 102 are laminated.

A first blower 60 is disposed at the upstream side of the pressing means in the conveying direction. The first blower 60 is disposed so as to face the gap defined between the two rollers 50, 51. The first blower 60 blows hot air having for instance a temperature of 550° C. towards the resin film 105 supplied to the gap. That is, the first blower 60 heats up the resin film 105. Consequently, the resin film 105 is attached to the cover band 104 and the substrate band 102 in a semi molten state.

The gap has the height dimension which allows the cover band 104 to be compressed against the substrate band 102 such that the bottom layer 4*b* of the cover band 104 is complementarily conformed to the surface structure of the second main side 102*b* of the substrate band 102. Meanwhile, the resin film 105 is much thinner than the cover band 104 and the substrate band 102.

A second blower 61 is disposed at the downstream side of the pressing means in the conveying direction. The second blower blows compressed air having a temperature lower than the hot air of the first blower 60 towards the laminate 100 fed from the gap defined between the rollers 50, 51. That is, the second blower 61 cools down the cover band 104 and the substrate band 102 immediately after the adhesion. Consequently, the adhesive layer (the resin film 105) in the semi molten state, which is adhesively attached to the cover band 104 and the substrate band 102 is solidified and thus the form of the adhesive layer is stabilized. The laminate 100 essentially has the structure shown in FIG. 3.

In the lamination process described above, the bottom layer 4*b* of the cover band 104 is essentially complementarily conformed to the surface structure of the second main surface 2*b*. That is, the bottom layer 4*b* is compressed in a thickness direction of the cover band 104 to fill the concaves on the second main side 102*b* of the substrate band 102. Consequently, the bottom layer 4*b* absorbs the concave and convex on the second main side 102*b* to smooth the top surface of the cover band 104 which is laminated on the second main side 102*b*.

Consequently, in the laminate 100, the surface structure of the second main side 102*b* of the substrate band 102 is no longer perceivable to the eye and/or the touch.

Thus, only the design or the desired surface texture carried out by the cover band 104 can be perceived from the outside, whereas the irregular, rough surface structure of the substrate band 102 is no longer perceivable.

Figure 5:
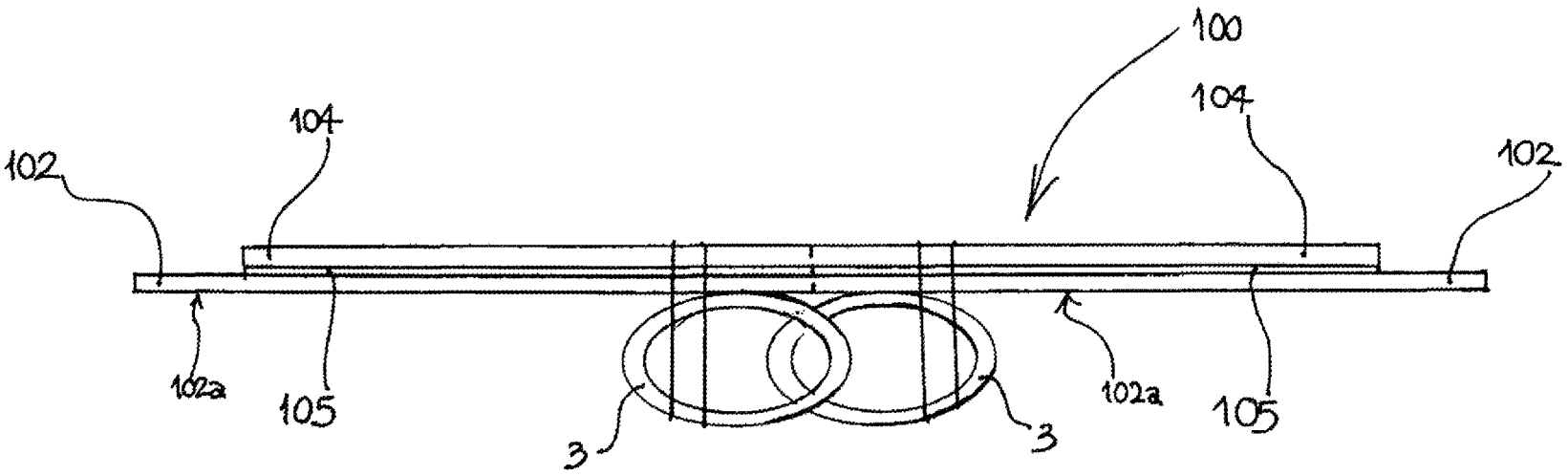
FIG. 5 is a transverse cross-sectional view showing a step of lamination in a method for manufacturing stringers according to the present invention.
Figure 6:
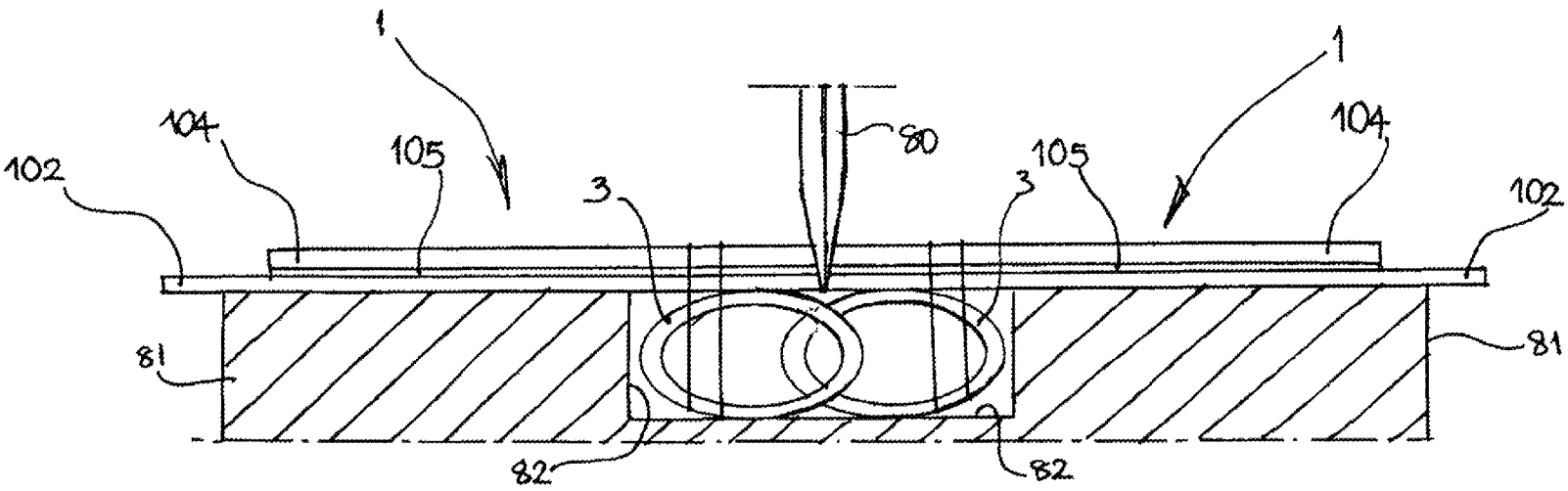
FIG. 6 is a transverse cross-sectional view showing a step of lamination in a method for manufacturing stringers according to the present invention.

According to a first embodiment illustrated in FIGS. 5 and 6, the laminate 100 is provided with two coupling elements 3 affixed by stitching to the first main side 102*a* of the substrate band 102. The coupling elements 3 are affixed to the first main side 102*a* of the substrate band 102 after the cover band 104 is affixed to the substrate band 102. The stitches pass through the substrate band 102 as well as through the cover band 104, as shown in FIG. 5.

Preferably, the two coupling elements 3 are affixed to the substrate band 102 in their mutually coupled condition.

The laminate 100 is cut by means of for instance a cutting blade 80 (FIG. 6) at the center thereof in a width direction, after stitching the coupling elements 3. Consequently, two confronting stringers 1 can be obtained. The cutting operation is appropriately performed while the laminate 100 is supported by a supporting member 81, as shown in FIG. 6. The supporting member 81 is provided with a recess portion 82 for accommodating the coupling elements 3.

As an alternative, the laminate 100 can be cut into two stringers 1 by means of a per se known ultrasonic (sonotrode) cutting apparatus. The cutting step is not needed in a case where a single stringer is manufactured independently.

Figure 7:
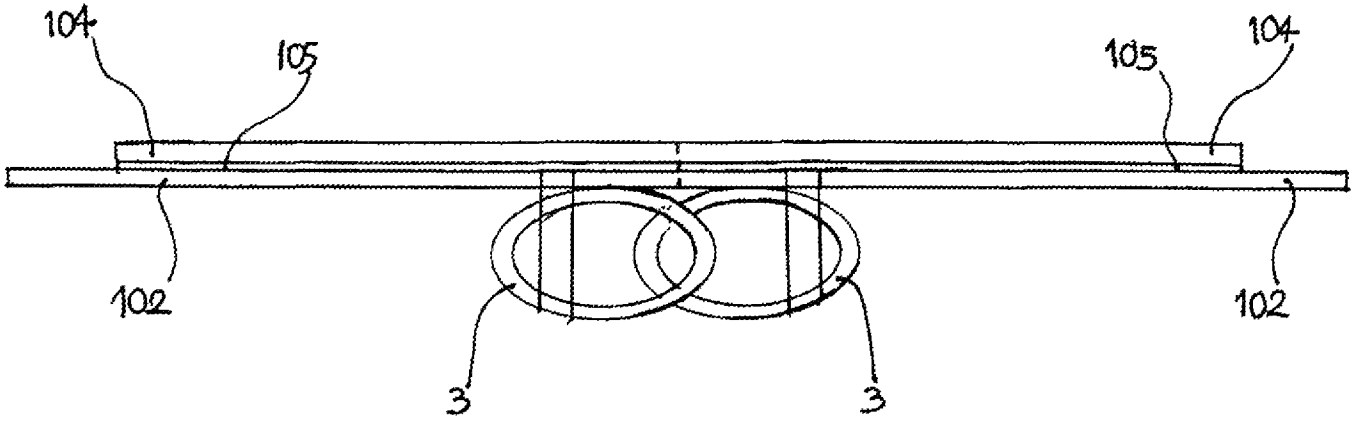
FIG. 7 is a transverse cross-sectional view similar to FIG. 5, showing a variant of the embodiment according to the present invention.

FIG. 7 shows a variant embodiment. The coupling elements 3 are affixed to the first main side 102*a* of the substrate band 102 before the cover band 104 is adhesively attached thereto. At this time, the stitches pass through only the substrate band 102, while not passing through the cover band 104. In this embodiment, the lamination apparatus shown in FIG. 4 can still be used for attaching the cover band 104 to the substrate band 102. However, in this case, a suitable recess portion is to be provided in one roller 51 to accommodate the coupling elements 3.

In variants of embodiments not shown in the drawings, the resin film 105 could be originally attached either to the substrate band 102 or the cover band 104. In this case, the resin film 105 is intended to melt and adhesively attach to the two bands.

In further embodiment, other kinds of adhesives, for instance liquid adhesives, can be used instead of resin film.

Naturally the principle of the invention remaining the same, various variants and modifications can be envisaged by the person skilled in the art, without thereby departing from the scope of the invention, which is ultimately defined in the appended claims.

DESCRIPTION OF REFERENCE NUMERALS

1 Slide Fastener Stringer
2 Substrate Tape
2*a* First Main Side
2*b* Second Main Side
3 Coupling Element (Gripping Means)
4 Cover Sheet
4*a* Top Surface
4*b* Bottom Layer
5 Resin Film (Adhesive Layer)
50, 51 Roller
60 First Blower
61 Second Blower
80 Cutting Blade
81 Supporting Member
82 Recess Portion
100 Laminate
102 Substrate Band (Substrate Tape)
102*a* First Main Side
102*b* Second Main Side
104 Cover Band (Cover Sheet)
105 Resin Film (Adhesive Layer)

The invention claimed is:

1. A slide fastener stringer, comprising:

a substrate tape comprising a first main side having a first rough surface structure perceptible to the eye and/or the touch and a second main side opposite to the first main side, the second main side having a second rough surface structure;

gripping means affixed to a longitudinal edge of the first main side of the substrate tape; and a cover sheet made of an artificial flexible material and having a top surface provided with a predetermined design and a bottom layer made of a thermoformable material having a predetermined thickness, wherein the bottom layer is attached to the second main side of the substrate tape such that the second rough surface structure of the second main side of the substrate tape is not perceivable through the cover sheet, the first and second rough surface structures are irregular surfaces comprised of a plurality of convexes and concaves, the cover sheet is attached to the substrate tape by means of a resin film, the bottom layer of the cover sheet is made of a compressible material, and the bottom layer is compressed in a thickness direction thereof to absorb the convexes and concaves of the second main side such that the second rough surface structure of the second main side is not perceivable through the cover sheet.

2. The slide fastener stringer according to claim 1, wherein the substrate tape includes a fabric made of interlaced, woven, knitted or knotted fibers, filaments, threads or yarns.

3. The slide fastener stringer according to claim 1, wherein the gripping means comprise a coil-like coupling element stitched to the substrate tape.

4. The slide fastener stringer according to claim 3, wherein the coupling element is stitched to at least one of the substrate tape and the cover sheet.

5. The slide fastener stringer according to claim 1, wherein neither a thickness of the substrate tape nor a thickness of the cover sheet is 50% greater than the other.

6. The slide fastener stringer according to claim 1, wherein a width of the substrate tape is greater than a width of the cover sheet and an outer end portion of the second main side of the substrate tape is exposed to the outside.

7. A method for manufacturing a slide fastener stringer, the method comprising:

providing a substrate band comprising a first main side having a first rough surface structure perceptible to the eye and/or the touch and a second main side opposite to the first main side, the second main side having a second rough surface structure;

providing a cover band made of an artificial flexible material and having a top surface provided with a predetermined design and a bottom layer made of a thermoformable material having a predetermined thickness;

adhesively attaching the bottom layer of the cover band to the second main side of the substrate band such that the bottom layer of the cover band is essentially complementarily conformed to the second rough surface structure of the second main side of the substrate band, the first and second rough surface structures are irregular surfaces comprised of a plurality of convexes and concaves, the cover band is attached to the substrate band by means of a resin film, the bottom layer of the cover band is made of a compressible material, and the bottom layer is compressed in a thickness direction thereof to absorb the convexes and concaves of the second main side such that the second rough surface structure of the second main side is not perceivable through the cover band.

8. The method according to claim 7, wherein a gripping member is affixed to the first main side of the substrate band after the cover band is affixed to the substrate band.

9. The method according to claim 7, wherein a gripping member is affixed to the first main side of the substrate band before the cover band is affixed to the substrate band.

10. The method according to claim 7, wherein the substrate band and the cover band are cut at the center thereof in a width direction.

11. The method according to claim 7, wherein a width of the substrate band is greater than a width of the cover band and outer end portions of the second main side of the substrate band are exposed to the outside.

* * * * *